US006550186B2

(12) United States Patent
Haq

(10) Patent No.: US 6,550,186 B2
(45) Date of Patent: Apr. 22, 2003

(54) CENTRIFUGAL FORCE ACTUATED DOOR SAFETY MECHANISM

(76) Inventor: Ataul Haq, 14214 Fisher Ave., Woodbridge, VA (US) 22191

( * ) Notice: Subject to any disclaimer, the term of this patent is extended or adjusted under 35 U.S.C. 154(b) by 0 days.

(21) Appl. No.: 09/924,508

(22) Filed: Aug. 9, 2001

(65) Prior Publication Data

US 2002/0157319 A1 Oct. 31, 2002

Related U.S. Application Data

(60) Provisional application No. 60/286,549, filed on Apr. 27, 2001.

(51) Int. Cl.[7] ..... E06B 7/36

(52) U.S. Cl. ..... 49/383; 16/83; 16/DIG. 17

(58) Field of Search ..... 16/82, 83, DIG. 17; 292/DIG. 19; 49/70, 383

(56) References Cited

U.S. PATENT DOCUMENTS

| | | | | | |
|---|---|---|---|---|---|
| 347,517 | A | * | 8/1886 | Saunders | 16/82 |
| 463,821 | A | * | 11/1891 | Wright | 16/83 |
| 1,037,641 | A | * | 9/1912 | Koch | 16/83 |
| 1,044,225 | A | | 11/1912 | Molin | |
| 1,117,230 | A | | 11/1914 | Page | |
| 1,221,580 | A | * | 4/1917 | Oliver | 16/83 |
| 1,399,145 | A | | 12/1921 | Naslin | |
| 1,459,238 | A | | 6/1923 | Naslin | |
| 1,685,023 | A | | 9/1928 | Cowan | |
| 1,869,415 | A | | 8/1932 | Fulton | |
| 2,142,753 | A | * | 1/1939 | Hulcher | 16/83 |
| 2,175,403 | A | * | 10/1939 | Larson | 16/83 |
| 2,401,301 | A | * | 6/1946 | Hoen | 16/83 |
| 2,693,615 | A | | 11/1954 | Hatke | |
| 3,879,895 | A | | 4/1975 | Hinderks | |
| 4,261,140 | A | | 4/1981 | McLean | |
| 5,813,091 | A | * | 9/1998 | Chaumat | 16/82 |

* cited by examiner

*Primary Examiner*—Gregory J. Strimbu
(74) *Attorney, Agent, or Firm*—Richard C. Litman

(57) ABSTRACT

A mechanism for preventing injury to a person's (especially a child's) hand when a fast-closing door slams against a door frame or jamb. The mechanism comprises a casing which is positioned within a hollowed out portion of the door. The casing is constructed with an opening disposed along the edge of the door. A metallic pendulum is housed and suspended within the casing such that the action of centrifugal force imparted by the fast-closing door will cause the pendulum to swing outwardly through the opening. A raised metal body is attached to the side molding of the door jamb and functions to engage the outwardly swung pendulum to prevent the door from completely closing.

6 Claims, 4 Drawing Sheets

CENTRIFUGAL FORCE ACTUATED DOOR SAFETY MECHANISM

CROSS-REFERENCE TO RELATED APPLICATION

This application claims the benefit of U.S. Provisional Patent Application Ser. No. 60/286,549, filed Apr. 27, 2001.

BACKGROUND OF THE INVENTION

1. Field of the Invention

The present invention generally relates to safety devices. More specifically, the present invention is drawn to apparatus for preventing a door from slamming against the fingers of a person, especially a child, whose hand might be positioned in the path of the fast-closing door.

2. Description of Related Art

The sickening sound of a fast-closing door panel crunching against fingers which move too slowly is only secondary to they excruciating pain felt by the person whose fingers happen to be caught between the slamming door panel and the jamb. There are many devices known in the art for preventing the above cited occurrence. For example U.S. Pat. No. 1,044,225 (Molin) and U.S. Pat. No. 1,117,230 (Page) show devices actuated by centrifugal force to swing between a screen door and the jamb to prevent the door from slamming. The devices of the above patents are of the pendant type and are disposed in an unsightly manner on the outer surface of the door panel. The patentees do not contemplate preventing damage to the door jamb nor do they discuss the concept of providing enough clearance to prevent the crushing of a person's fingers.

U.S. Pat. No. 1,399,145 (Naslin), U.S. Pat. No. 1,459,238 (Naslin), U.S. Pat. No. 1,869,415 (Fulton), U.S. Pat. No. 2,693,615 (Hatke) and U.S. Pat. No. 4,261,140 (McLean) each disclose a door check device housed in casing structure. The device is designed to swing outwardly from the casing structure to prevent the door from slamming. Each casing is mounted on the door in an exposed and relatively unsightly manner. No provision is made in any of the instant patents, to protect the door jamb from damage nor is there any discussion of providing clearance to prevent finger mashing.

U.S. Pat. No. 1,685,023 (Cowan) is drawn to a door check device mounted on a door stop. The check device does not appear to provide enough clearance between the door and the jamb to prevent a person's fingers form being mashed.

U.S. Pat. No. 3,879,895 (Hinderks) discloses a device for an automobile door, which device is designed to protect the edge of the door from damage. The patentee does not contemplate preventing a person's fingers from being caught.

None of the above inventions and patents, taken either singly or in combination, is seen to disclose a safety door slam mechanism and jamb protector as will subsequently be described and claimed in the instant invention.

SUMMARY OF THE INVENTION

The present invention is drawn to an uncomplicated mechanism for preventing injury to a person's (especially a child's) hand when a fast-closing door slams against a door frame or jamb. The mechanism comprises a casing, which casing is positioned within a hollowed-out portion of the door and is constructed with an opening disposed along the edge of the door panel. A metallic pendulum is housed and suspended within the casing such that the action of centrifugal force imparted by a fast-closing door will cause the pendulum to swing outwardly through the opening.

A raised, metal body is attached to the side molding of the door jamb and functions to engage the outwardly swung pendulum to prevent the door from completely closing. As contemplated, a positive clearance of at least approximately one-half inch is created between the door panel and the jamb to avoid crushing of the child's fingers. A signaling device is actuated when the pendulum swings from the casing.

Accordingly, it is a principal object of the invention to provide a safety mechanism for a fast-moving door, which mechanism prevents the fast-moving door from slamming directly against the door jamb.

It is another object of the invention to provide a safety mechanism for a fast-moving door, which mechanism prevents the fast-moving door from crushing the fingers of a child's hand which might be between the door panel and door jamb.

It is a further object of the invention to provide a safety mechanism for a fast-moving door, which mechanism is actuated by the centrifugal force imparted by the fast-moving door.

Still another object of the invention is to provide a safety mechanism for a fast-moving door, which mechanism includes a body attached to the door jamb.

It is an object of the invention to provide improved elements and arrangements thereof in a safety mechanism for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
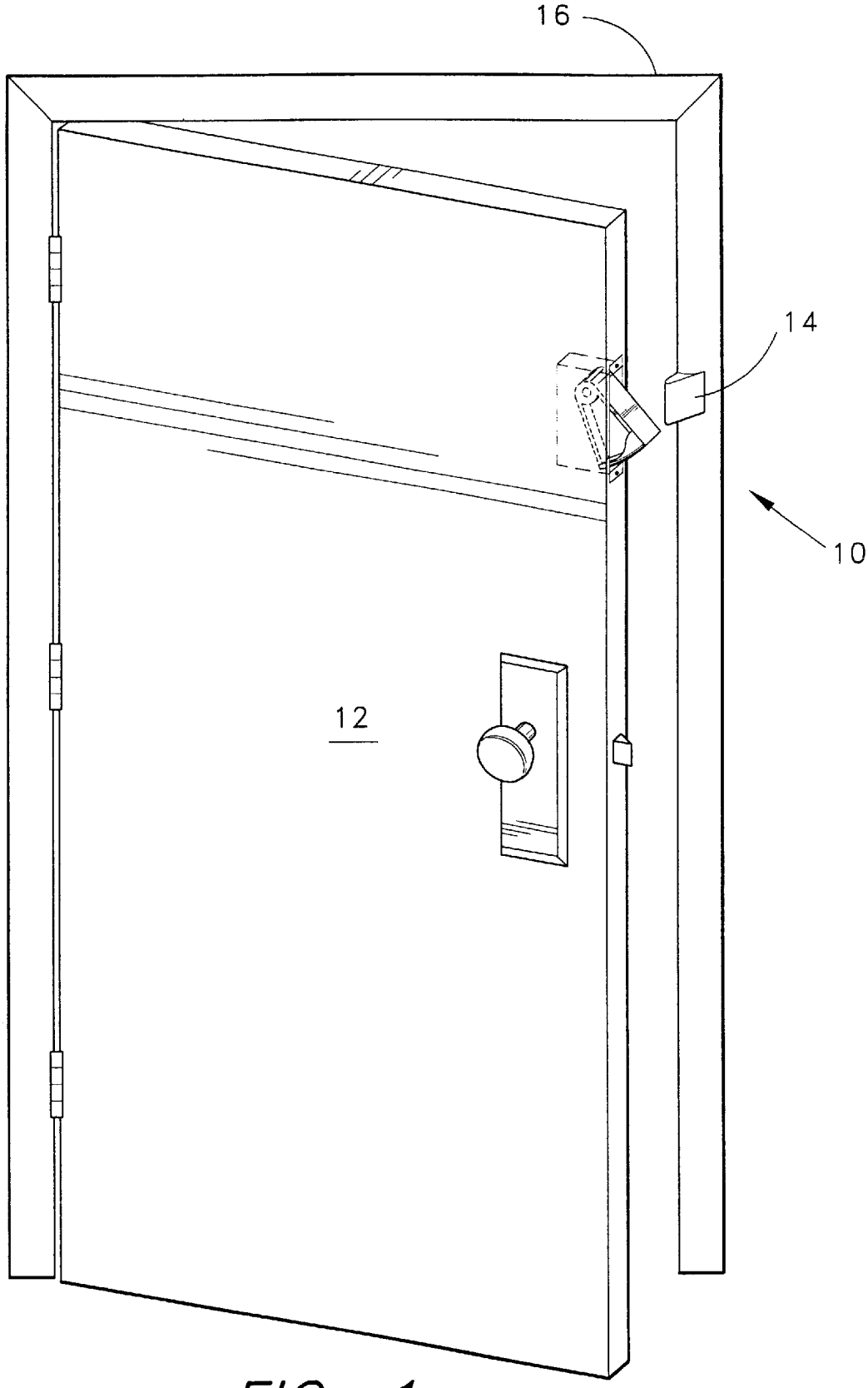
FIG. 1 is an environmental, perspective view of a door slam safety mechanism according to the present invention.
Figure 4:
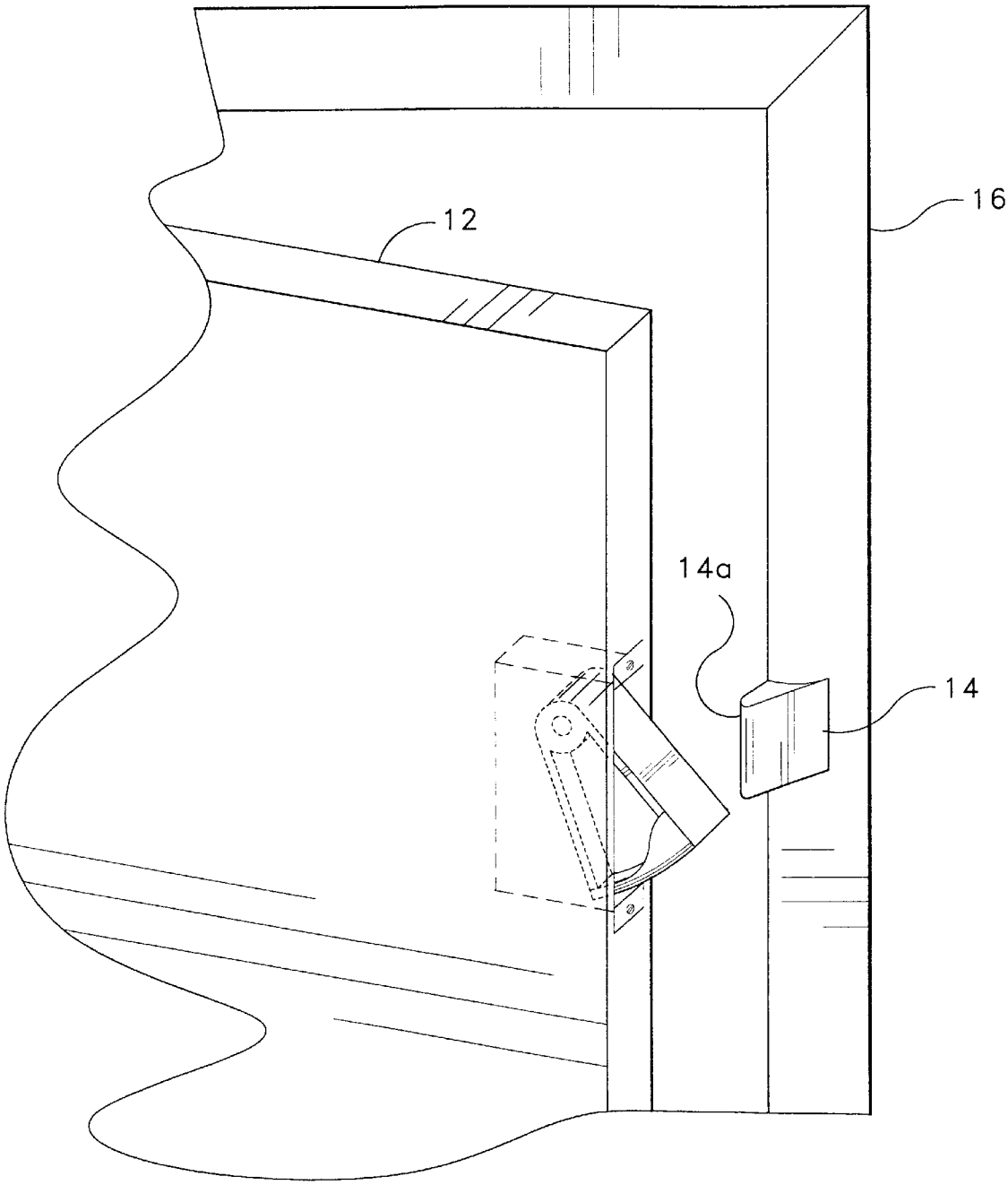
FIG. 4 is a partial view of a door jamb and raised plate of a door slam safety mechanism according to the present invention.

As best illustrated in FIGS. 1 and 4, the safety mechanism of the present invention is indicated generally at 10. Mechanism 10 is disposed in a hollowed out portion of a door panel 12. Mechanism 10 is positioned toward the upper end of door panel 12 for reasons as will be explained below. A raised body 14 is attached to the molding 16 of the door jamb which is disposed around the door panel and abuts the door panel when in a closed position. Body 14 may be attached to the molding in any convenient and efficient manner (screws, welding, glue, etc.). Although contemplated as made from metal, body 14 may be fabricated from any rugged and durable material (plastic, composite, etc.). Body 14 is formed with a rounded edge 14*a* to lessen the probability of injury and is brightly colored to be noticeable.

Figure 2:
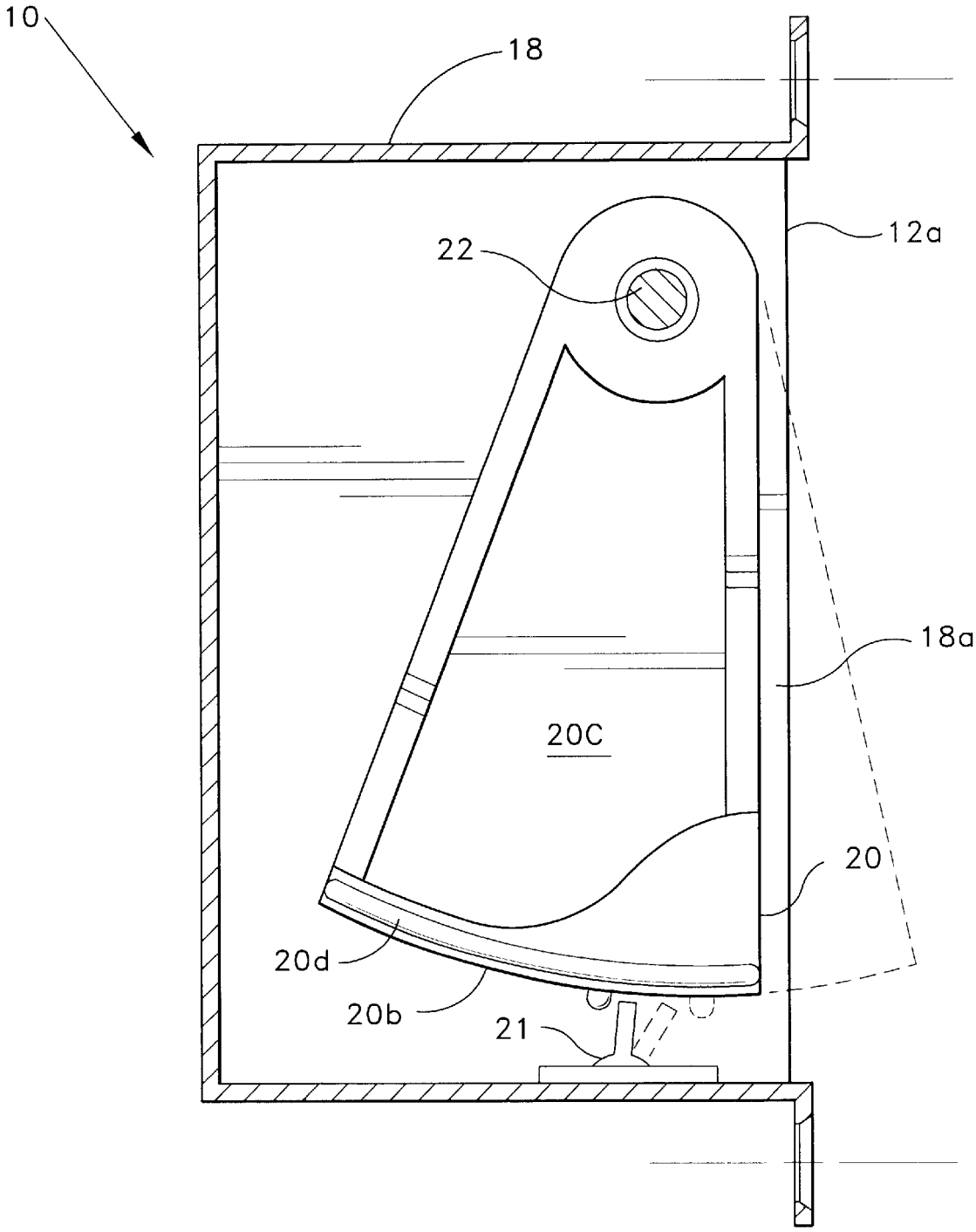
FIG. 2 is a sectional view of the housing and pendulum of a door slam safety mechanism according to the present invention.

As best seen in FIG. 2, mechanism 10 includes a generally rectangular casing 18 disposed in a hollowed out portion of door panel 12 disposed in a side edge of the door panel. Casing 18 is provided with rear, top, bottom, and side walls. The side walls defining a space therebetween. The casing has an open front 18*a* which is coincident with the front edge 12*a* of door panel 12. A pendulum 20 is normally housed inside of casing 18. Pendulum 20 is suspended from pivot pin 22 spanning the space between the side walls for unfettered swinging movement. Casing 18 is securely fastened in the door panel with screws or the like. A signaling device 21 is positioned to emit an audible signal when the pendulum swings from the casing.

Figure 3:
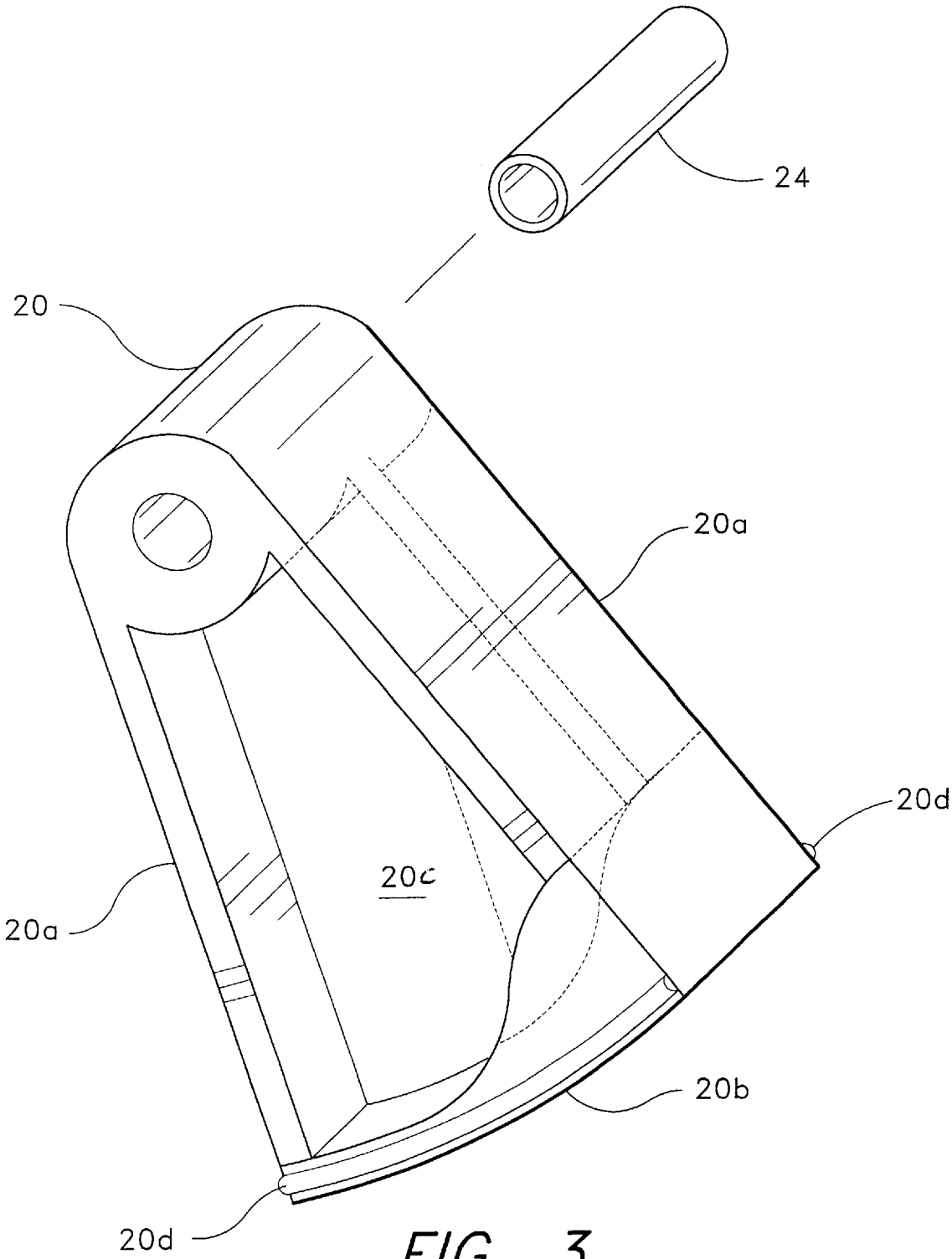
FIG. 3 is an exploded, perspective view of a pendulum and nylon bushing of a door slam safety mechanism according to the present invention.

As best seen in FIG. 3, pendulum 20 is of modified triangular configuration having legs 20*a* and base 20*b*. A web member 20*c* is positioned in the center of the pendulum for added strength. Ridges 20*d* are formed on the outer, lower sides of the pendulum for enhance stability and minimize friction. A high percentage of the total weight of pendulum 20 is concentrated in the forward end of base 20*b* for reasons as will be explained below. A nylon bushing 24 is adapted to be disposed between the pendulum and the pivot pin 22 to alleviate frictional forces.

In operation, pendulum 20 is normally entirely housed within casing 18 as shown in FIG. 2. Since a high percentage of the pendulum's weight is concentrated at its forward end, the centrifugal force produced when the door panel is closed at a speed that would produce a slamming effect, will cause the pendulum to swing outwardly from casing 18 and engage body 14 as shown in FIG. 1. This engagement will create a clearance between the door panel and the jamb, thus preventing the panel from crushing a person's fingers which might be in the space between the panel and the jamb. The raised body also prevents the pendulum from directly impacting and causing damage to the door jamb. When the door panel is at rest, the pendulum will move back to its plumb position which is inside the casing. Although the safety system of the instant invention may be located at any position along the front edge of the door, a position toward the upper end has been found to lessen the chance that a child might sustain injury by inadvertently running into the raised body 14.

It is to be understood that the present invention is not limited to the sole embodiment described above, but encompasses any and all embodiments within the scope of the following claims.

I claim:

1. A door slam safety mechanism comprising:

a door panel, said door panel having a side edge, an upper end and a lower end;

a door jamb, said door jamb forming a frame around and adjacent to said door panel and adapted to abut said door panel when said door panel is in a closed position;

a raised body attached to said door jamb;

a hollowed-out portion formed in the side edge of said door panel;

a casing disposed in said hollowed-out portion, said casing having a top wall, a bottom wall, side walls defining a space therebetween, a rear wall and an open front face;

a pivot pin positioned in said casing and spanning the space between the side walls;

a nylon sheath disposed around said pivot pin;

a weighted pendulum, said pendulum being housed in said casing and disposed on said nylon sheath and pivot pin for swinging movement thereon;

said weighted pendulum having a triangular configuration having a front leg, a rear leg, and a base connecting said front leg to said rear leg, said base having a first side and a second side;

a first ridge disposed on said first side of said base and a second ridge disposed on said second side of said base; and a web member, said web member positioned at a central portion of said pendulum wherein said web member extends from said front leg to said rear leg.

2. A door slam mechanism recited in claim 1, wherein the weight of said weighted pendulum is concentrated in said base adjacent said front leg.

3. A door slam safety mechanism as recited in claim 2, wherein said hollowed-out portion and said raised body are positioned adjacent said upper end of said door panel.

4. A door slam safety mechanism as recited in claim 2 including means for emitting an audible signal when said pendulum extends out of said casing.

5. A door slam safety mechanism as recited in claim 2, wherein said raised body is attached to said door jamb in an area to be impacted by said pendulum when extended.

6. A door slam safety mechanism as recited in claim 5, wherein a rounded, leading edge is formed on said raised body.

* * * * *